US007454155B2

(12) United States Patent
Tomatsu

(10) Patent No.: US 7,454,155 B2
(45) Date of Patent: Nov. 18, 2008

(54) IMAGE FORMING APPARATUS HAVING FOOT PORTIONS COUPLED TO A BOTTOM SURFACE THEREOF

(75) Inventor: Yoshiya Tomatsu, Kasugai (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 98 days.

(21) Appl. No.: 11/564,499

(22) Filed: Nov. 29, 2006

(65) Prior Publication Data

US 2007/0154234 A1 Jul. 5, 2007

(30) Foreign Application Priority Data

Nov. 29, 2005 (JP) ..... 2005-344328

(51) Int. Cl.
*G03G 15/00* (2006.01)

(52) U.S. Cl. ..... 399/107; 347/108

(58) Field of Classification Search ..... 399/107; 347/108, 152, 263
See application file for complete search history.

(56) References Cited

U.S. PATENT DOCUMENTS 6,308,025 B1 10/2001 Okano et al.
6,473,152 B1 * 10/2002 Yokota ..... 347/108 X
6,530,634 B1 * 3/2003 Hara ..... 347/108 X
2003/0035040 A1 * 2/2003 Hwang ..... 347/108
2005/0123318 A1 * 6/2005 Nishitani et al. ..... 399/107
2005/0162496 A1 * 7/2005 Elenes ..... 347/108

FOREIGN PATENT DOCUMENTS

| | | |
|---|---|---|
| JP | 2000-101256 | 4/2000 |
| JP | 2000-310930 | 11/2000 |
| JP | 2001-051462 | 2/2001 |
| JP | 2001-117302 | 4/2001 |
| JP | 2004-272081 | 9/2004 |
| JP | 2005-148171 | 6/2005 |

OTHER PUBLICATIONS

Machine translation of JP 2004-272081 A dated May 2, 2008.*

* cited by examiner

*Primary Examiner*—Sophia S Chen
(74) *Attorney, Agent, or Firm*—Banner & Witcoff, Ltd.

(57) ABSTRACT

An image forming apparatus includes an apparatus body, a pair of first foot portions which is disposed close to one side of a bottom surface of the apparatus body and has a first distance therebetween, and a pair of second foot portions which is disposed close to another side of the bottom surface and has a second distance therebetween, the second distance being shorter than the first distance, wherein the pair of second foot portions is attached to the apparatus body via a resilient member, the resilient member being vertically deformable.

12 Claims, 6 Drawing Sheets

IMAGE FORMING APPARATUS HAVING FOOT PORTIONS COUPLED TO A BOTTOM SURFACE THEREOF

CROSS-REFERENCE TO RELATED APPLICATION

This application claims priority from Japanese Patent Application No. 2005-344328, filed on Nov. 29, 2005, the entire subject matter of which is incorporated herein by reference.

TECHNICAL FIELD

The present invention relates to an image forming apparatus.

BACKGROUND

In an image forming apparatus such as a laser printer, foot portions generally protrude from four corners on a bottom surface having a longitudinal rectangular shape. When an apparatus body is placed on a horizontal installation surface, the apparatus body is supported by allowing four foot portions to abut on a top of the installation surface. However, when the installation surface is uneven, a body frame may be crooked along unevenness. When the body frame is crooked, alignment of parts may be out of order. Thus, image quality may be adversely affected, and a phenomenon such as displacement of printing positions of images may occur.

As a countermeasure, JP-A-2005-148171 discloses a configuration in which three foot portions are disposed in a triangular shape on a bottom surface of the apparatus body. By supporting the apparatus body at three points, an apparatus frame can be prevented from being crooked due to an influence of unevenness of the installation surface. However, when the apparatus body is supported at three points, stability of the apparatus may be deteriorated and the apparatus can be tilted.

SUMMARY

Aspects of the invention provide an image forming apparatus which is less affected by unevenness of an installation surface and which has an excellent stability.

DETAILED DESCRIPTION

<General Overview>

Figure 1:
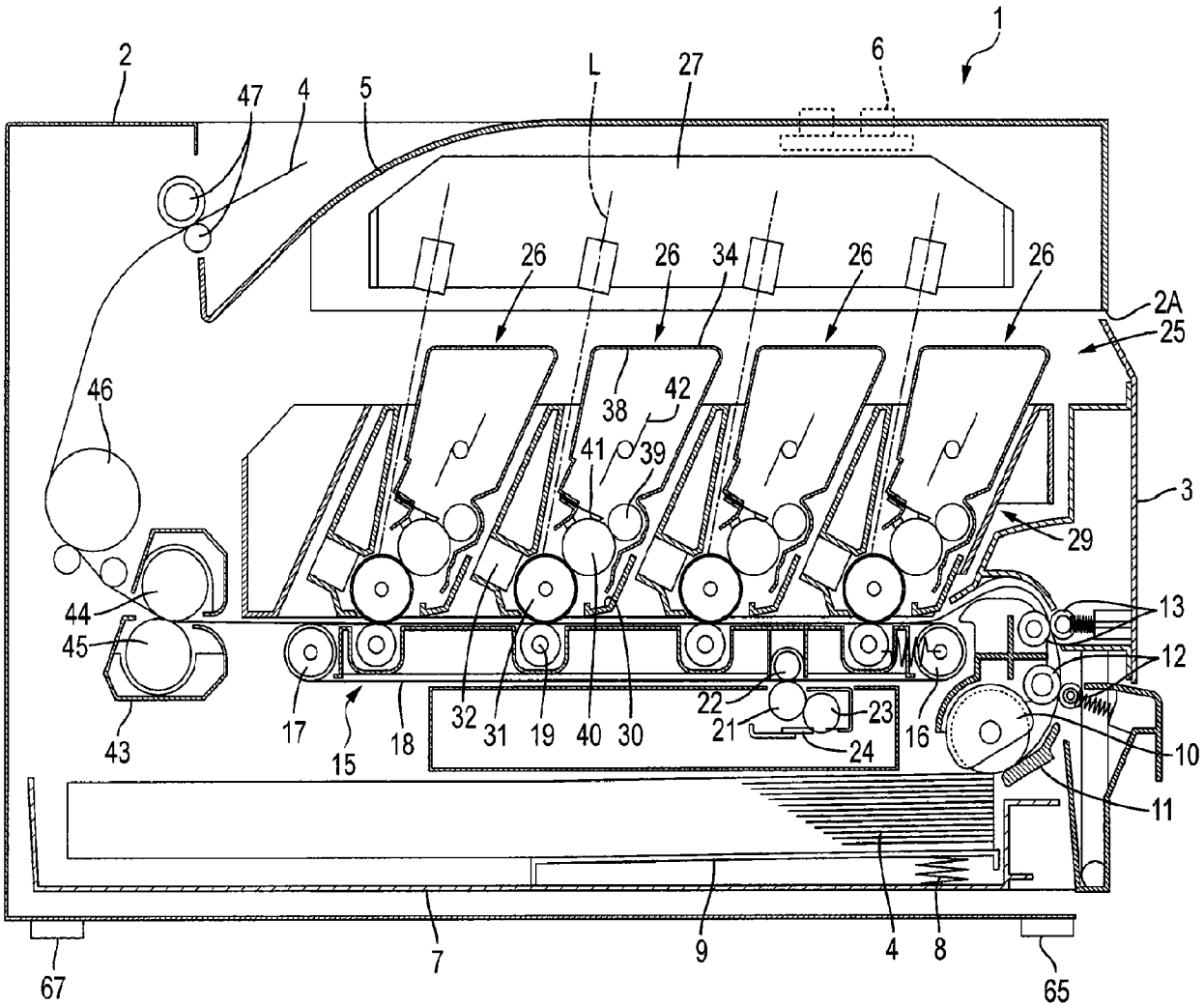
FIG. 1 is a side sectional view illustrating a schematic configuration of a laser printer according to an aspect of the invention.

According to a first aspect of the invention, there is provided an image forming apparatus comprising: an apparatus body; a process unit which has an image carrier and can be mounted to or demounted from the apparatus body; a pair of first foot portions which is disposed close to one side of a bottom surface of the apparatus body and has a first distance therebetween; and a pair of second foot portions which is disposed close to another side of the bottom surface and has a second distance therebetween, the second distance being shorter than the first distance, wherein the pair of second foot portions is attached to the apparatus body via a resilient member, the resilient member being vertically deformable.

According to a second aspect of the invention, the image forming apparatus further comprises a body frame disposed in the apparatus body and having a pair of sidewalls, wherein the resilient member bridges the sidewalls.

According to a third aspect of the invention, the image forming apparatus further comprises an operating panel, wherein the pair of first foot portions is disposed in a position closer to the operating panel than a center of gravity of the apparatus body in a plan view.

According to a fourth aspect of the invention, the apparatus body includes a loading port for mounting and demounting the process unit, and the pair of first foot portions is disposed in a position closer to the loading port than a center of gravity of the apparatus body in a plan view.

According to a fifth aspect of the invention, the image forming apparatus further comprises a pair of tilt-control portions which is disposed close to the another side of the apparatus body so as to interpose the pair of second foot portions therebetween and has a protruding length shorter than that of the second foot portions.

According to a sixth aspect of the invention, the pair of tilt-control portions is provided so as to contact with the installation surface when the apparatus body is tilted relative to the installation surface.

According to a seventh aspect of the invention, the image forming apparatus further comprises a pair of tilt-control portions which is disposed close to the one side of the bottom surface of the apparatus body so as to interpose the pair of first foot portions therebetween and has a protruding length shorter than that of the first foot portions.

According to an eighth aspect of the invention, the pair of tilt-control portions is provided to contact with the installation surface when the apparatus body is tilted relative to the installation surface.

According to a ninth aspect of the invention, at least one of the pair of first foot portions and the pair of second foot portions include an elastic rubber member.

The distance between a pair of foot portions disposed close to the opposite edge is shorter than the distance between a pair of foot portions disposed close to one edge. Accordingly, the body frame is less crooked due to the influence of unevenness of the installation surface than that of the case where four foot portions are disposed in a rectangular shape on four corners of the bottom surface. The apparatus body is more stable and less crooked than that of the case where three foot portions are disposed in a triangular shape on the bottom surface.

The pair of foot portions having a short distance is attached through the resilient member. Accordingly, a vertical error due to the unevenness of the installation surface or the error in protruding length of the foot portions is absorbed by the resilient member. Thus, foot portions having a short distance properly come in contact with the installation surface without floating. Accordingly, a load of the apparatus body is distributed into the pair of foot portions having a short distance and the body frame can be prevented from being crooked by one of the foot portions having a short distance.

The resilient member bridges the sidewalls of the body frame. Accordingly, the sidewalls are strongly connected to each other.

The pair of foot portions having a long distance is disposed close to the operating panel. Accordingly, the apparatus body does not shake even by a downward pressing of the apparatus body at the time of a user's operating the operating panel.

The foot portions having a long distance are disposed close to the loading port of a process unit. Accordingly, when a position of center of gravity is shifted toward the loading port at the time of mounting and demounting the process unit, the tilt of the apparatus body can be prevented.

The tilt-control portions come in contact with the installation surface due to the tilt of the apparatus body. Accordingly, the tilt of the apparatus body can be prevented.

The tilt-control portions come in contact with the installation surface due to the tilt of the apparatus body. Accordingly, the tilt of the apparatus body can be prevented.

<Illustrative Aspects>

Hereinafter, an aspect of the present invention will be described with reference to the drawings.

(Example Structure of Laser Printer)

Figure 2:
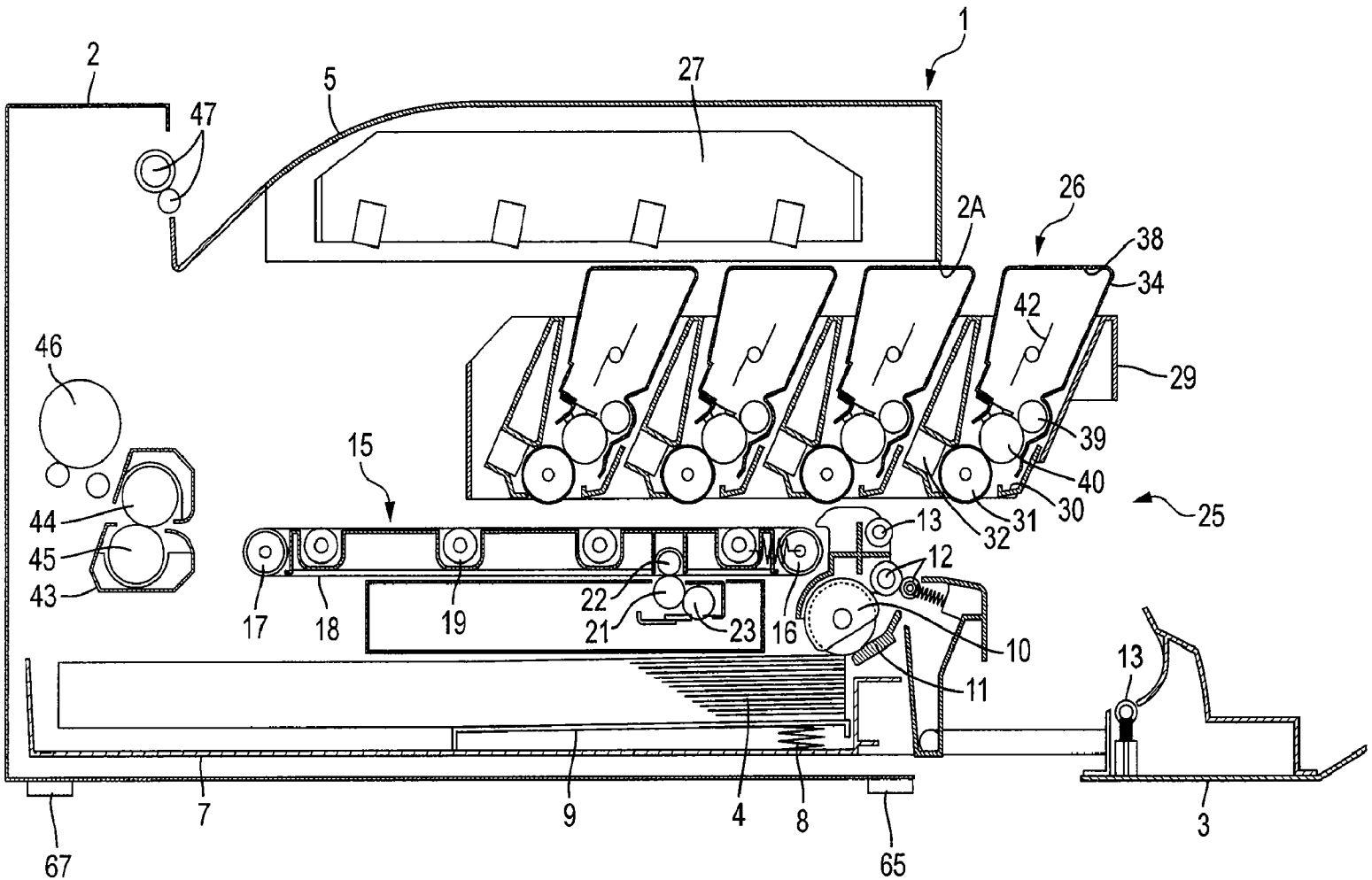
FIG. 2 is a side sectional view of the laser printer illustrating a state where a process unit is being drawn out.

FIG. 1 is a side sectional view of a laser printer 1 as an image forming apparatus according to an aspect of the invention. FIG. 2 is a side sectional view of the laser printer 1 in a state where a process unit 25 is being drawn out. In the following description, the right side in FIG. 1 denotes the front side.

The laser printer 1 is a color laser printer of a direct transfer tandem type and includes a body casing 2 (apparatus body) having a substantially box shape as shown in FIG. 1. A loading port 2A is opened in the front surface of the body casing 2, the loading port 2A is covered with a front cover 3 being opened and closed, and a process unit 25 can be drawn out forwardly through the loading port 2A from the body casing 2, as shown in FIG. 2, by opening the front cover 3. A discharge tray 5 on which sheets 4 as a printing medium having been subjected to image formation are piled is formed on the top surface of the body casing 2. On the top surface of the body casing 2, an operating panel 6 having a power button for turning on and off a power source is disposed at a position close to the front-left end as viewed from the front side about the discharge tray 5.

A sheet feed tray 7, on which the sheets 4 for forming an image is stacked, is mounted on a bottom surface of the body casing 2. A sheet pressing plate 9 is disposed in the sheet feed tray 7. The sheet plate 9 can be tilted so as to raise a leading end of a sheet 4 when a bias force of a spring 8 is applied. A pickup roller 10 and a separation pad 11 are disposed at an upper position of a front end of the sheet feed tray 7. The separation pad 11 is pressed into contact with the pickup roller 10 by a bias force of a spring (not shown). A pair of feed rollers 12 is disposed on the tilted front upper side of the pickup roller 10. A pair of resist rollers 13 is disposed above the feed rollers 12.

The uppermost sheet of the sheets 4 in the sheet feed tray 7 is pressed to the pickup roller 10 by the sheet pressing plate 9. The uppermost sheet is separated from the sheets 4 when it is inserted between the pickup roller 10 and the separation pad 11 by the rotation of the pickup roller 10. The sheet 4 fed out of between the pickup roller 10 and the separation pad 11 is sent to the resist rollers 13. The resist rollers 13 feed the sheet 4 onto a belt unit 15 at a predetermined time.

The belt unit 15 can be attached to and detached from the body casing 2 and includes a convey belt 18. The convey belt 18 is horizontally suspended across a pair of belt supporting rollers 16 and 17 which are disposed apart from each other in an anteroposterior direction. The convey belt 18 is an endless belt 18 formed by a resin material such as polycarbonate. The convey belt circulates in the counterclockwise direction of FIG. 1 with the rotation of the rear belt supporting roller 17 and conveys the sheet 4 placed thereon backwardly. In the convey belt 18, four transfer rollers 19 disposed opposite to photosensitive drums 31 of image forming units 26 (described later) are disposed with a constant pitch in the anteroposterior direction. Thus, the convey belt 18 is interposed between the photosensitive drums 31 and the transfer rollers 19, respectively. At the time of transfer, a transfer bias is applied across the transfer rollers 19 and the photosensitive drums 31.

A cleaning roller 21 for removing a toner or paper dust attached to the convey belt 18 is disposed below the belt unit 15. The cleaning roller 21 has a structure that a foamed material made of silicon is disposed around a metal shaft. The convey belt 18 is interposed between a metal backup roller 22 disposed in the belt unit 15 and the cleaning roller 21. A predetermined bias is applied across the cleaning roller 21 and the backup roller 22 to electrically attract the toner, etc. on the convey belt 18 toward the cleaning roller 21. A metal collection roller 23 for removing the toner, etc. attached to the surface of the cleaning roller abuts on the cleaning roller 21. A blade 24 for scraping off the toner, etc. attached to the surface of the collection roller 23 abuts on the collection roller 23.

A scanner unit 27 is disposed in the upper portion of the body casing 2. A process unit 25 is disposed below the scanner unit 27. The belt unit 15 is disposed below the process unit 25.

The scanner unit 27 irradiates laser beams L by colors based on predetermined image data to the surfaces of the corresponding photosensitive drums 31 in a high-speed scanning manner.

The process unit 25 can be drawn out forwardly from the body casing 2. The process unit 25 can be mounted on and demounted from the body casing 2. The process unit 25 includes four image forming units 26 corresponding to magenta, yellow, cyan, and black. The image forming units 26 are arranged in parallel in an anteroposterior direction. Each image forming unit 26 includes a photosensitive drum 31 as an image carrier, a scorotron type charger 32, and a developing cartridge 34 as a developing unit. The process unit 25 includes a process frame 29 having four cartridge mounting units 30 disposed in parallel in the anteroposterior direction. Each cartridge mounting unit 30 is mounted with the corresponding developing cartridge 34. The corresponding developing cartridge 34 can be attached to and detached from the cartridge mounting unit 30 in a state where the process frame 29 is drawn forwardly from the loading port 2A. In the process frame 29, the photosensitive drums 31 of the image forming units 26 are held at the lower end positions of the cartridge mounting units 30. The scorotron type charging units 32 are held adjacent to the photosensitive drums 31.

Each photosensitive drum 31 includes a grounded metal drum body. The uppermost layer of the drum body is covered with a positively charged photosensitive layer which is made of polycarbonate or the like.

The scorotron type charger 32 is disposed opposite to the photosensitive drum 31 with a predetermined gap. Thus, the scorotron type charger 32 does not contact with the photosensitive drum in the tilted rear upper portion of the corresponding photosensitive drum 31. The scorotron type charger 32 uniformly charges the surface of the photosensitive drum 31 with positive charge by generating corona discharge from a charging wire (not shown) made of tungsten or the like.

The developing cartridge 34 has a substantially box shape. Toner receiving chambers 38 are disposed in an upper portion of the inside of the developing cartridge 34. A supply roller 39, a developing roller 40 and a thickness-control blade 41 are disposed in a lower side of the developing cartridge 34. Positively charged non-magnetic toners of yellow, magenta, cyan and black as developers are received in the toner receiving chambers 38. An agitator 42 for agitating the toner is disposed in each toner receiving chamber 38.

The supply roller 39 has a structure in that a metal roller shaft is coated with a conductive foam material. The developing roller 40 has a structure that a metal roller shaft is coated with a conductive rubber material. The toner supplied from the toner receiving chambers 38 is supplied to the developing roller 40 with the rotation of the supply rollers 39 and is charged to a positive charge between the supply roller 39 and the developing roller 40. The toner advances between the thickness-control blade 41 and the developing roller 40 with the rotation of the developing roller 40 and is sufficiently charged therein. The toner is held on the developing roller 40 as a thin layer with a constant thickness.

The surface of the photosensitive drum 31 is uniformly charged to a positive charge by the scorotron type charger 32 at the time of rotation thereof. Thereafter, the surface of the photosensitive drum 31 is exposed to light by high-speed scanning of a laser beam L from the scanner unit 27. Thus, an electrostatic latent image corresponding to an image to be formed on the sheet 4 is formed thereon.

When the toner held on the developing roller 40 comes in contact with the photosensitive drum 31 with the rotation of the developing roller 40, the toner is supplied to the electrostatic latent image formed on the surface of the photosensitive drum 31. Accordingly, the electrostatic latent image on the photosensitive drum 31 is visualized. Further, a toner image in which the toner is attached to only the exposed portion is formed on the photosensitive drum 31.

Thereafter, the toner image formed on the surface of each photosensitive drum 31 is transferred to the sheet 4 by a negative transfer bias applied to the transfer rollers 19 while the sheet 4 conveyed by the convey belt 18 passes through transfer positions between the photosensitive drums 31 and the transfer rollers 19. The sheet 4 to which the toner images are transferred is conveyed to the fixing unit 43.

The fixing unit 43 is disposed in the back of the convey belt 18 in the body casing 2. The fixing unit 43 includes a heating roller 44 and a pressing roller 45. The heating roller has a heat source such as a halogen lamp and is rotatable. The pressing roller 45 is oppositely disposed below the heating roller 44 to press the heating roller 44 and rotates with the rotation of the heating roller 44. The fixing unit 43 fixes the toner images onto the sheet 4 by heating the sheet 4 holding four color toner images while interposing and conveying the sheet 4 between the heating roller 44 and the pressing roller 45. The thermally fixed sheet 4 is conveyed to a discharge roller 47 disposed in the upper portion of the body casing 2 by the convey roller 46, which is disposed on the tilted rear upper side of the fixing unit 43. The sheet is discharged onto the discharge tray 5 by the discharge roller 47.

(Structure for Supporting Body Casing)

Figure 3:
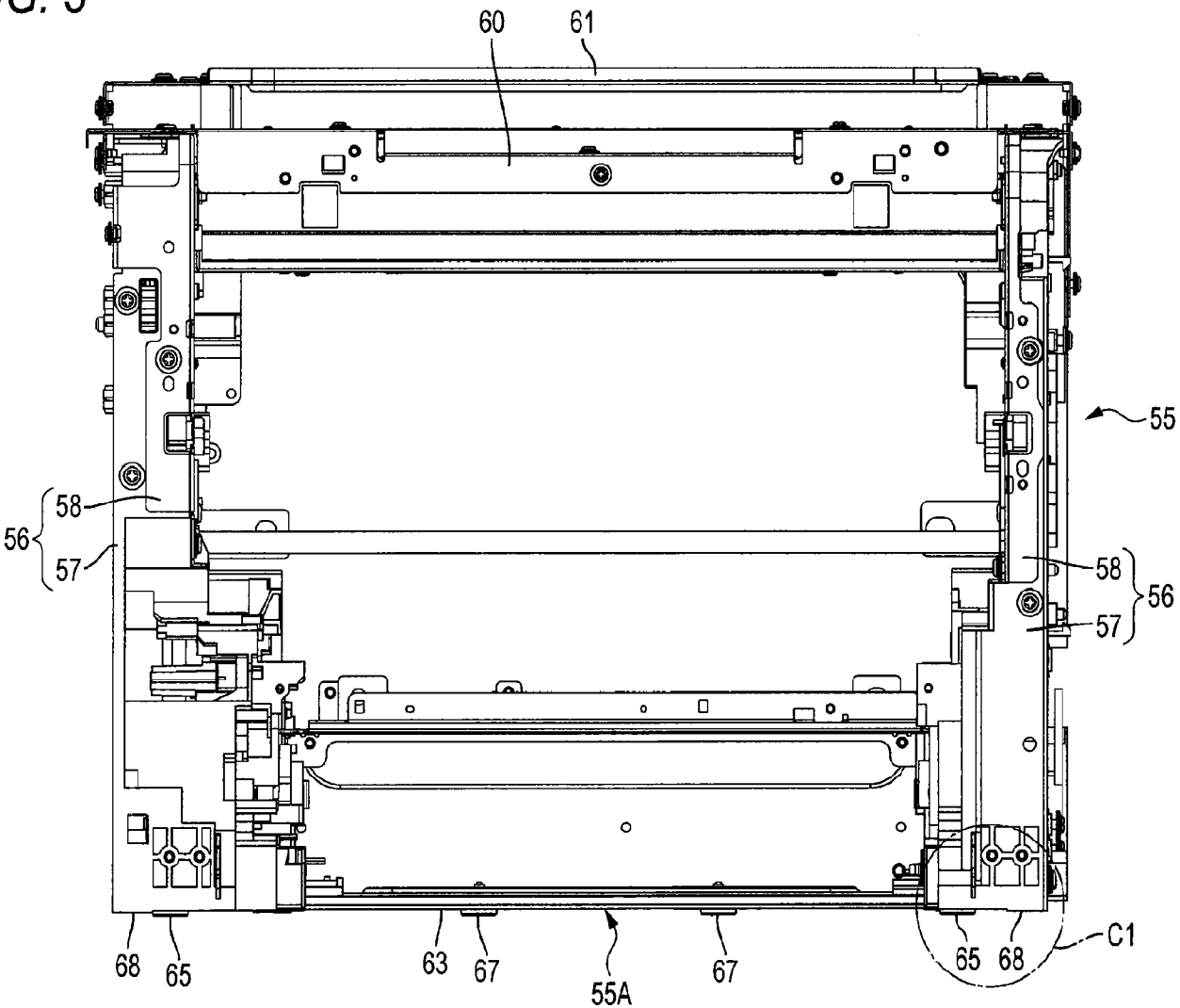
FIG. 3 is a front view of a body frame.
Figure 4:
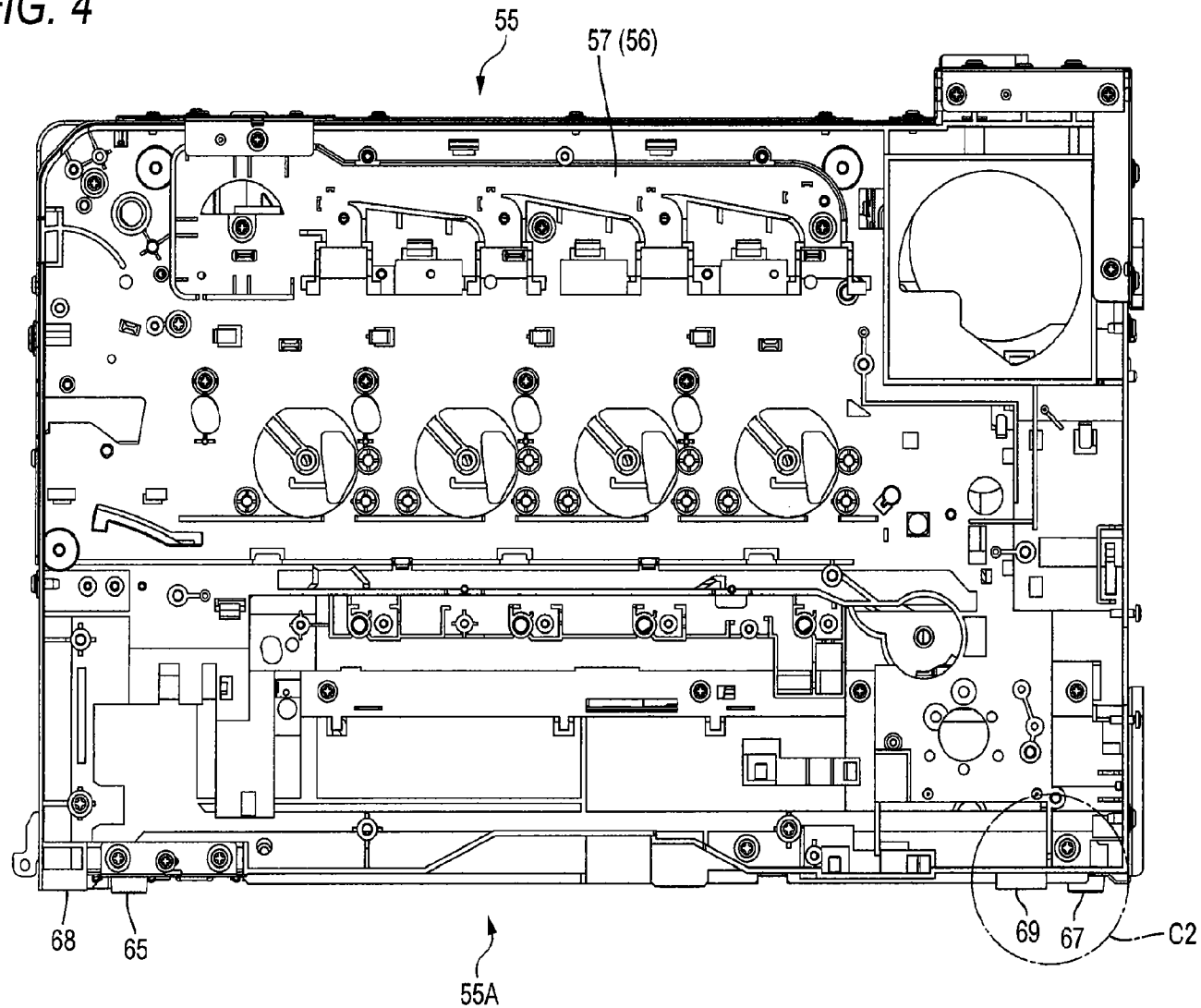
FIG. 4 is a side view of the body frame.
Figure 5:
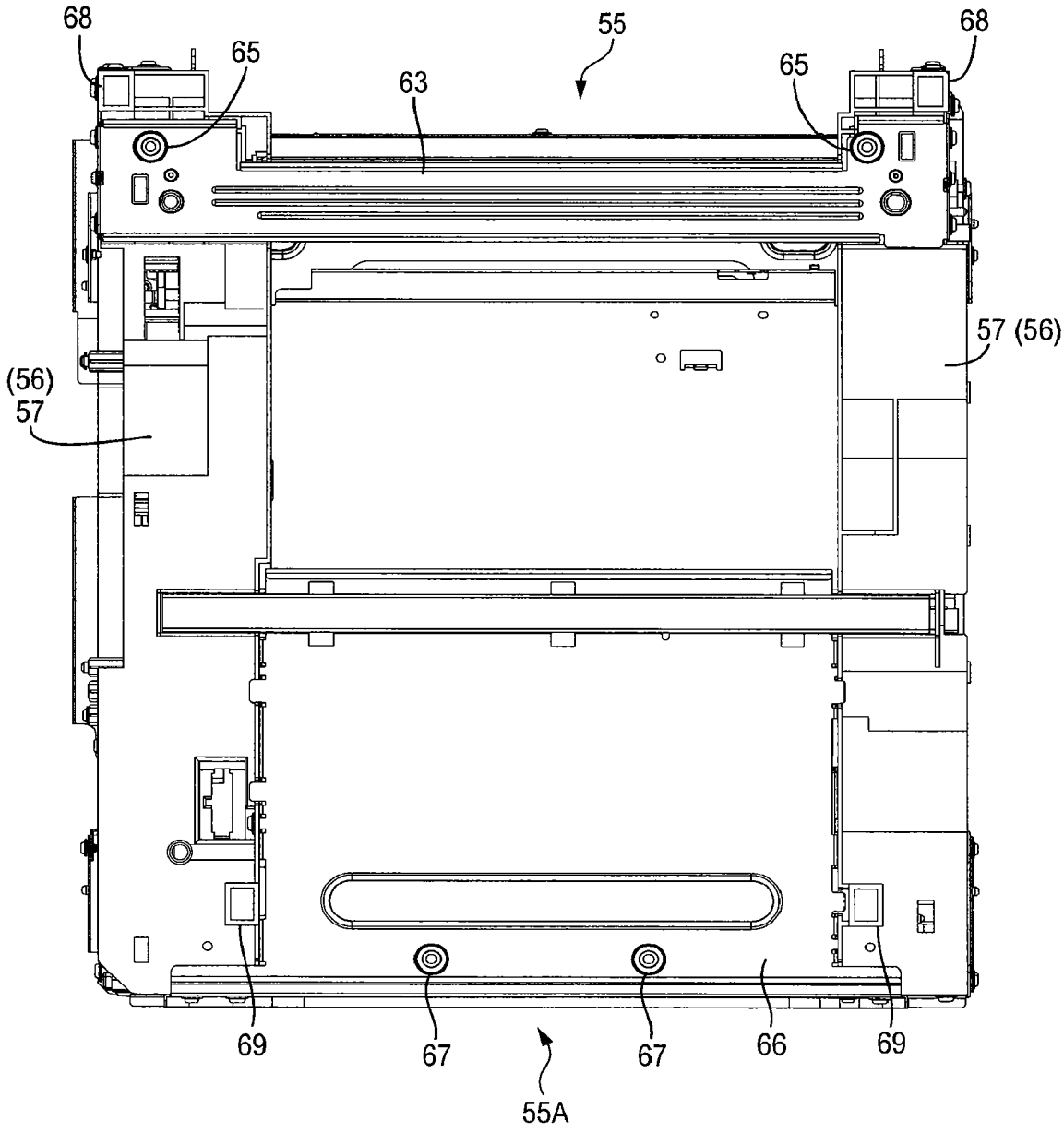
FIG. 5 is a bottom view of the body frame.
Figure 6:
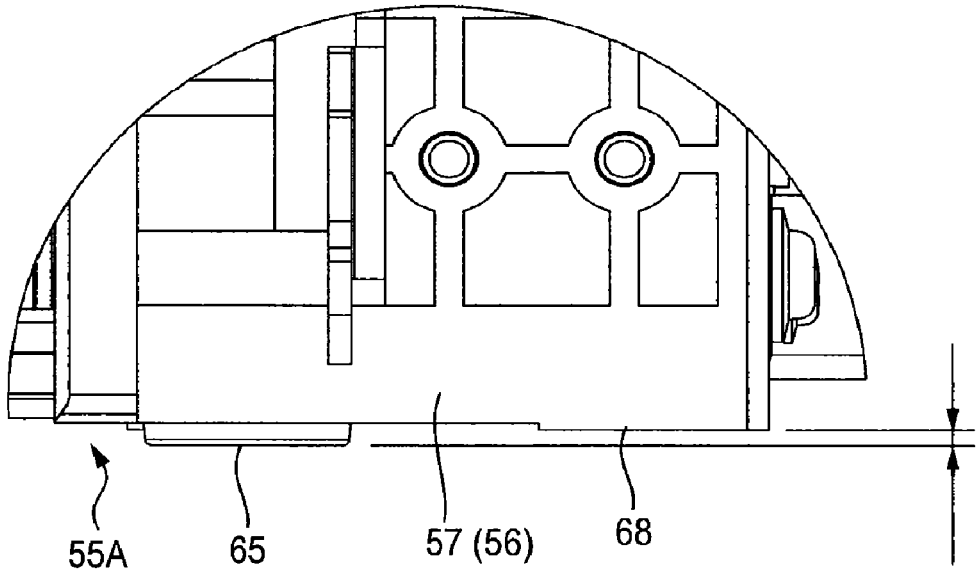
FIG. 6 is an enlarged view of circle C1 shown in FIG. 3.
Figure 7:
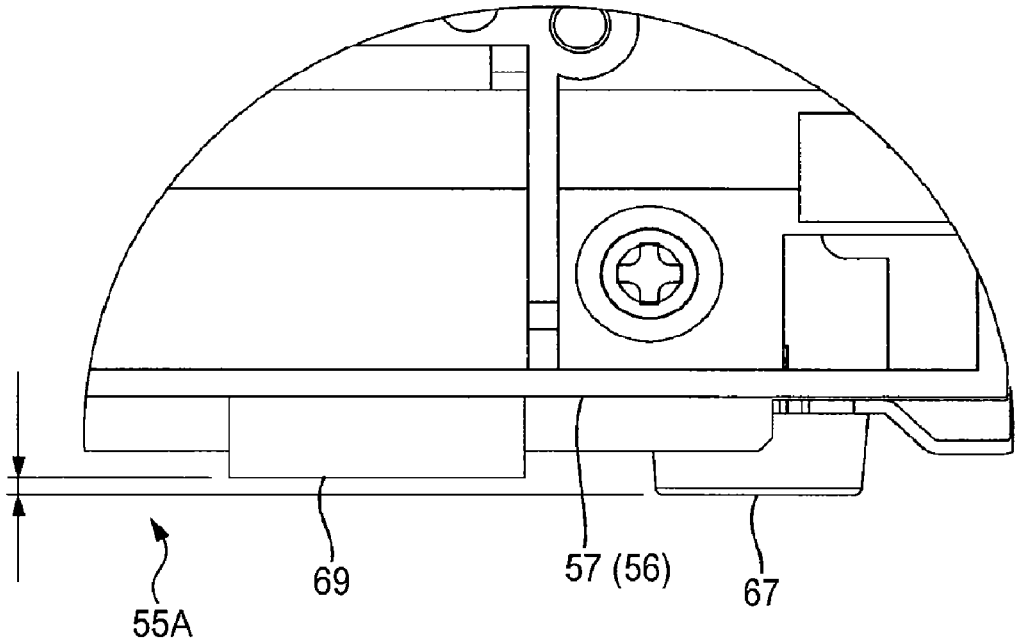
FIG. 7 is an enlarged view of circle C1 shown in FIG. 4.

A structure for supporting the body casing 2 will be described. FIG. 3 is a front view illustrating the body frame 55. FIG. 4 is a side sectional view illustrating the body frame 55. FIG. 5 is a bottom view illustrating the body frame 55. FIG. 6 is an enlarged view of circle C1 shown in FIG. 3. FIG. 7 is an enlarged view of circle C2 shown in FIG. 4.

The body casing 2 includes the body frame 55 and a resin outer cover (not shown). The resin outer cover covers a part of the outer surface of the body frame 55. The body frame 55 has a rectangular shape opened in an anteroposterior direction as a whole as shown in FIGS. 3 to 5 and includes a pair of sidewalls 56. Each of the sidewalls 56 includes a resin sidewall portion 57 made of a synthetic resin and a sheet-metal sidewall portion 58 which is made of a sheet metal and is superposed on the resin sidewall portion 57 on the inner surface side thereof.

A metal front beam 60 bridges the sidewalls 56 in a position close to the front end of the top of the body frame 55. A metal rear beam 61 having a sectional shape of "L" bridges the sidewalls 56 in a position close to the rear end of the top of the body frame 55.

The bottom surface 55A of the body frame 55 has a substantially rectangular shape as shown in FIG. 5. A bottom beam 63 is made of a metal sheet having an elongated shape. The bottom beam 63 bridges the sidewalls 56 in a position close to the front end (front edge of four edges of the bottom surface 55A) of the bottom surface 55A between the sidewalls 56. Both lateral ends of the bottom beam 63 are fixed with overlapping the lower surfaces of the resin sidewalls 57. A pair of front foot portions 65 (first foot portion) is attached to the lower surfaces of the portions overlapping the resin sidewalls 57 (see also FIG. 6). The pair of front foot portions 65 is made of an elastic rubber member and has a substantially tapered shape. The pair of front foot portions 65 is screwed to the bottom beam 63.

A metal bottom plate 66 (resilient member) bridges the resin sidewalls 57 in a rear position of the bottom surface 55A of the body frame 55. A part of the bottom surface 55A is covered with the bottom plate 66. The bottom plate 66 has a proper resilient property and the middle portion thereof is resiliently deformed in a vertical direction, A pair of rear foot portions 67 (second foot portion) is attached to the rear end of the bottom plate 66. That is, the pair of rear foot portions 67 is attached to a position close to the rear edge of fourth edges of the bottom surface 55A (see also FIG. 7). The pair of rear foot portions 67 is made of an elastic rubber member and has a substantially tapered cylindrical shape. The pair of rear foot portions 67 is screwed to the bottom plate 66. The front foot portions 65 and the rear foot portions 66 are symmetrically disposed, respectively. The rear foot portions 67 are disposed closer to the lateral center than the front foot portions 65. In other words, the distance between the pair of rear foot portions 67 is shorter than the distance between the pair of front foot portions 65. The distance between the pair of rear foot portions 67 may be about one-third of the distance between the pair of front foot portions 65. The line connecting the four foot portions 65 and 67 forms a platform shape. When the laser printer 1 is placed on a horizontal installation surface, the four foot portions 65 and 67 come in contact with the installation surface to support the body frame 55.

Tilt-control portions 68 are disposed at a front right corner of the bottom surface 55A of the body frame 55 and at the front left corner. In other words, a pair of tilt-control portions 68 is disposed closer to the front edge of four edges of the bottom surface 55A than both front foot portions 65 so as to laterally interpose both front foot portions 65 therebetween. Both tilt-control portions 68 are formed integrally with the lower surface of the resin sidewalls 57 and protrude downwardly in a rectangular shape. The length of both tilt-control portions 68 protruding from the bottom surface 55A is shorter than the length of the front foot portions 65, as shown in FIG. 6.

A pair of tilt-control portions 69 is disposed close to the rear edge of the bottom surface 55A of the body frame 55. More specifically, a pair of tilt-control portions 69 is disposed on the front side of the pair of rear foot portions 67 so as to laterally interpose the pair of rear foot portions 67 therebetween. Both tilt-control portions 69 are formed integrally with the lower surfaces of the resin sidewalls 57 and protrude downwardly in a rectangular shape. The protruding length of both tilt-control portions 69 from the bottom surface 55A is shorter than the protruding length of the rear foot portions 67, as shown in FIG. 7.

(Advantages)

According to this aspect, the distance between a pair of rear foot portions 67 disposed close to the rear edge is shorter than the distance between a pair of front foot portions 65 disposed close to the front edge. Accordingly, the body frame 55 is less crooked due to the influence of unevenness of the installation surface than that of the case where four foot portions are disposed in a rectangular shape on four corners of the bottom surface. A laser printer 1 is more stable and less tilted than that of the case where three foot portions are disposed in a triangular shape on the bottom surface.

A pair of rear foot portions 67 is attached through the bottom plate 66 having a resilient property. Accordingly, the vertical error due to the unevenness of the installation surface or the error in protruding length of the foot portions 65 and 67 is absorbed by the bottom plate 66 and both rear foot portions 67 properly come in contact with the installation surface without floating. Therefore, the load of the body frame 55 is distributed into the pair of rear foot portions 67 and the body frame 55 can be prevented from being crooked by one of the rear foot portions 67.

The bottom plate 66 made of a resilient member bridges the sidewalls 56 of the body frame 55. Accordingly, the sidewalls 56 are strongly connected to each other.

A pair of front foot portions 65 having a long distance is disposed close to the operating panel 6. Accordingly, the laser printer 1 does not shake even by the downward pressing of the body casing 2 at the time of a user's operating the operating panel 6.

The pair of front foot portions 65 having a long distance is disposed close to the loading port 2A provided in the front surface of the body casing 2. Accordingly, even when a position of center of gravity is shifted toward the loading port 2A at the time of drawing out the process unit 25 and mounting or demounting the process cartridge 34, the tilt of the laser printer 1 can be prevented.

Even when the laser printer 1 is inclined, the tilting thereof is prevented by allowing the tilt-control portions 68 and 69 to abut on the installation surface for the laser printer 1.

(Other Aspects)

The invention is not limited to the aspect described above with reference to the drawings, but the following aspects can be included in the technical scope of the invention.

Although the invention is applied to the electrophotographic color laser printer, the invention is not limited to this aspect. The invention may be applied to image forming apparatuses of other printing types such as a monochrome printer and an ink jet printer having a single image carrier. This invention may also be applied to a multifunction machine having a facsimile function or a copier function.

What is claimed is:

1. An image forming apparatus comprising:

an apparatus body including body frame disposed therein, the body frame having a pair of sidewalls;

a process unit which has an image carrier and is configured to be mounted to or demounted from the apparatus body;

a pair of first foot portions coupled to one side of a bottom surface of the apparatus body and having a first distance therebetween; and a pair of second foot portions which is coupled to another side of the bottom surface and having a second distance therebetween, the second distance being shorter than the first distance, wherein the pair of second foot portions is coupled to the apparatus body via a resilient member, the resilient member being vertically deformable and bridging the sidewalls.

2. The image forming apparatus according to claim 1, further comprising an operating panel, wherein the pair of first foot portions is disposed in a position closer to the operating panel than a center of gravity of the apparatus body in a plan view.

3. The image forming apparatus according to claim 1, wherein the apparatus body includes a loading port for mounting and demounting the process unit, and wherein the pair of first foot portions is disposed in a position closer to the loading port than a center of gravity of the apparatus body in a plan view.

4. The image forming apparatus according to claim 1, further comprising a pair of tilt-control portions which is coupled to the another side of the apparatus body so as to interpose the pair of second foot portions therebetween and has a protruding length shorter than a protruding length of the second foot portions.

5. The image forming apparatus according to claim 4, wherein when the image forming apparatus is placed on an installation surface, each of the first and second pair of foot portions contacts the installation surface, and the pair of tilt-control portions is configured to contact the installation surface when the apparatus body is tilted relative to the installation surface.

6. The image forming apparatus according to claim 4, wherein a first of the tilt-control portions is provided in a first one of the sidewalls and a second of the tilt-control portions is provided in a second one of the sidewalls opposing the first one of the sidewalls.

7. The image forming apparatus according to claim 1, further comprising a pair of tilt-control portions which is coupled to the one side of the bottom surface of the apparatus body so as to interpose the pair of first foot portions therebetween and has a protruding length shorter than a protruding length of the first foot portions.

8. The image forming apparatus according to claim 7, wherein when the image forming apparatus is placed on an installation surface, each of the first and second pair of foot portions contacts the installation surface, and the pair of tilt-control portions is configured to contact the installation surface when the apparatus body is tilted relative to the installation surface.

9. The image forming apparatus according to claim 7, wherein a first of the tilt-control portions is provided in a first one of the sidewalls and a second of the tilt-control portions is provided in a second one of the sidewalls opposing the first one of the sidewalls.

10. The image forming apparatus according to claim 1, wherein at least one of the pair of first foot portions and the pair of second foot portions includes an elastic rubber member.

11. The image forming apparatus according to claim 1, further comprising a tilt-control portion which is coupled to the another side of the apparatus body and not interposed between the pair of second foot portions and having a protruding length shorter than a protruding length of the second foot portions.

12. The image forming apparatus according to claim 1, further comprising a tilt-control portion which is coupled to the one side of the apparatus body and not interposed between the pair of first foot portions and having a protruding length shorter than a protruding length of the first foot portions.

* * * * *